US010787813B2

(12) United States Patent
Mikulsky et al.

(10) Patent No.: US 10,787,813 B2
(45) Date of Patent: Sep. 29, 2020

(54) TENDON COUPLER

(71) Applicant: PRECISION-HAYES INTERNATIONAL INC., Seagoville, TX (US)

(72) Inventors: Nate Mikulsky, Brookfield, WI (US); Paul Hohensee, West Bend, WI (US); Thomas Mathews, Midlothian, TX (US)

(73) Assignee: PRECISION-HAYES INTERNATIONAL INC., Seagoville, TX (US)

( * ) Notice: Subject to any disclaimer, the term of this patent is extended or adjusted under 35 U.S.C. 154(b) by 0 days.

(21) Appl. No.: 16/388,580

(22) Filed: Apr. 18, 2019

(65) Prior Publication Data

US 2019/0323238 A1 Oct. 24, 2019

Related U.S. Application Data

(60) Provisional application No. 62/660,078, filed on Apr. 19, 2018.

(51) Int. Cl.
*E04C 5/12* (2006.01)
*E04G 21/12* (2006.01)

(52) U.S. Cl.
CPC ..... *E04C 5/122* (2013.01); *E04G 21/12* (2013.01)

(58) Field of Classification Search
CPC ..... E04C 5/122; E04C 5/165; E04G 21/12
See application file for complete search history.

(56) References Cited

U.S. PATENT DOCUMENTS 3,049,775 A * 8/1962 Ondeck ..... E04C 5/165 403/365
3,681,512 A * 8/1972 Werner ..... H01R 4/08 174/84 R
3,973,297 A 8/1976 Bruinette et al.
4,121,325 A 10/1978 Bruinette et al.
4,146,951 A * 4/1979 Howlett ..... E04C 5/122 29/452

(Continued)

FOREIGN PATENT DOCUMENTS

KR 20120133972 A 12/2012

OTHER PUBLICATIONS

European Search Report issued in EP App. No. 19170506.0, dated Sep. 18, 2019 (18 pages).

*Primary Examiner* — Joshua K Ihezie
(74) *Attorney, Agent, or Firm* — Adolph Locklar

(57) ABSTRACT

A coupler for connecting first and second tendons may comprise a body including first and second ends, a passageway therethrough and an access port; first and second wedges each configured to receive an end of the first and second tendons, respectively, each of the wedges being positioned in the passageway and oriented so as to resist withdrawal from the coupler of a tendon received therein; and first and second pistons positioned within the passageway proximate the first and second wedges, respectively; wherein the first and second pistons define a pressure chamber therebetween; wherein the pressure chamber is in fluid communication with the access port; and wherein the first and second pistons are configured to bear on the first and second wedges, respectively, and urge the first and second wedges apart in response to pressure in the pressure chamber.

16 Claims, 11 Drawing Sheets

(56) References Cited

U.S. PATENT DOCUMENTS

| | | | | |
|---|---|---|---|---|
| 4,212,558 | A | 7/1980 | Lang | |
| 4,223,497 | A | 9/1980 | Edwards | |
| 4,640,068 | A | 2/1987 | Jungwirth et al. | |
| 4,648,146 | A | 3/1987 | Nuetzel et al. | |
| 4,680,906 | A | 7/1987 | Prevendini | |
| 5,345,742 | A | 9/1994 | Rogowsky et al. | |
| 5,683,273 | A * | 11/1997 | Garver | H01R 4/5025 174/84 R |
| 5,742,653 | A | 4/1998 | Erbes et al. | |
| 6,151,850 | A | 11/2000 | Sorkin | |
| 6,176,051 | B1 * | 1/2001 | Sorkin | E04C 5/08 403/305 |
| 6,655,104 | B2 * | 12/2003 | Kadotani | E04C 5/08 52/647 |
| 6,761,002 | B1 * | 7/2004 | Sorkin | E04C 5/12 403/374.1 |
| 7,424,792 | B1 | 9/2008 | Sorkin | |
| 7,596,847 | B2 | 10/2009 | Carstensen | |
| 8,348,542 | B2 | 1/2013 | Church | |
| 8,904,721 | B2 | 12/2014 | Pantelides et al. | |
| 9,057,170 | B2 | 6/2015 | Tadros et al. | |
| 9,551,151 | B2 * | 1/2017 | Lee | E04C 5/165 |
| 10,196,820 | B2 | 2/2019 | Sorkin | |
| 10,378,210 | B2 | 8/2019 | Hayes | |
| 2014/0227024 | A1 * | 8/2014 | Gilling | E04C 5/165 403/286 |
| 2015/0337533 | A1 * | 11/2015 | Lee | E04C 5/165 403/314 |
| 2018/0335061 | A1 * | 11/2018 | Song | F16B 7/0426 |

* cited by examiner

TENDON COUPLER

CROSS-REFERENCE TO RELATED APPLICATIONS

This application claims priority from U.S. provisional application No. 62/660,078, filed Apr. 19, 2018.

FIELD

The present application relates to a coupler for joining tendons in concrete.

BACKGROUND

Concrete is capable of withstanding significant compressive loads but is more susceptible to failure when subjected to significant tensile loads. Concrete structures are often reinforced with steel bars or cables to enhance the structures ability to withstand tensile forces.

SUMMARY

In an aspect, a coupler for connecting an end of a first tendon to an end of a second tendon may include a body, at least one first wedge for receiving the end of the first tendon, and at least one second wedge for receiving the end of the second tendon. The body may have a first end and a second end and the at least one first wedge and the at least one second wedge may be positioned in the first and second ends of the body, respectively. The coupler may further include a first piston positioned proximate the first wedge and configured to apply a force on the first wedge toward the first end. The coupler may further include a second piston positioned proximate the second wedge and configured to apply a force on the second wedge toward the second end.

In some aspects, a coupler may include a first chuck that receives a first wedge and a second chuck that receives a second wedge. The first chuck may include an outer surface and first external threads. The second chuck may include an outer surface and second external threads. A first end of a coupler body may include first internal threads that engage the first external threads and a second end of a coupler body may include second internal threads that engage the second external threads.

In some aspects, a coupler may include a body with a passageway that may be in communication with an end surface of a first piston and with an end surface of a second piston. The passageway may be configured to receive a fluid, and the fluid may be configured to move the first piston and the second piston.

In some aspects, a coupler may include a body having a passageway therethrough and an aperture or access port that may be in fluid communication with the passageway. The aperture may be tapered proximate the passageway. The taper may increase the flowrate of a fluid received into the passageway.

In some aspects, a coupler may include a first piston and a second piston, which each include a recess. An end of a first tendon may be configured to be positioned in the recess of the first piston and an end of a second tendon may be configured to be positioned in the recess of the second piston.

In some aspects, a coupler may include a first chuck that has a first tapered chamber and a second chuck that has a second tapered chamber. A first wedge may be positioned in the first tapered chamber and a second wedge positioned in the second tapered chamber.

In some aspects, a coupler may include a first wedge and a second wedge that are initially disposed in a first position. The application of a force by a first piston on the first wedge inserts the wedge into a second, secured position and the application of a force by a second piston on the second wedge inserts the second wedge into a second, secured position.

In some aspects, a coupler may include a first piston and a second piston that are driven by a pressurized fluid positioned in the body. The pressurized fluid applies a pressure on the first piston and on the second piston.

In some aspects, a coupler may include a first piston and a second piston that are driven by a chemical reaction that increases pressure in a coupler body. The chemical reaction applies a pressure against the first piston and the second piston.

In some aspects, a coupler may include a chuck coupled to a first end of a coupler body. The chuck receives first wedges, which include an upper wedge and a lower wedge that together define a cavity. The upper wedge and the lower wedge are moveable out of the first chuck and into a passageway of the coupler body.

In another aspect, a coupler for connecting an end of a first tendon to an end of a second tendon may include a body, a first piston, and a second piston. The body may include a first end, a second end, and a passageway providing communication between the first end and the second end. The first piston may be positioned proximate the first end and driven to exert a first force toward the first end. The second piston may be positioned proximate the second end and driven to exert a second force toward the second end.

In some aspects, a coupler may include a first piston driven to exert a first force, and a second piston driven to exert a second force. The first force and the second force may be equal to one another.

In some aspects, a coupler may include a body with an aperture that may be oriented orthogonal to a passageway of the body. The passageway may be configured to receive a fluid through the aperture. The fluid may be configured to provide a first force to a first piston positioned in the body, and a second force to a second piston positioned in the body.

In some aspects, a coupler may include a first chuck with first wedges that receive an end of a first tendon. The coupler also may include a second chuck with second wedges that receive an end of a second tendon. A first end of a coupler body receives the first chuck and a second end of the coupler body receives the second chuck.

In some aspects, a coupler may include a first piston and a second piston. The first piston may apply a force on first wedges directed toward a first end of the coupler and the second piston may apply a force on second wedges directed toward a second end of the coupler.

In another aspect, a method for connecting an end of a first tendon to an end of a second tendon may include positioning a coupler between the end of the first tendon and the end of the second tendon, wherein the coupler may include a body with a first end and a second end and a passageway and first and second pistons positioned in the passageway proximate the first and second ends, respectively. A first chuck may be inserted into the first end of the body and a second chuck may be inserted into the second end of the body. The end of the first tendon may be inserted into first wedges of the first chuck, the first wedges supported by the first chuck, and the end of the second tendon may be inserted into second wedges of the second chuck, the second wedges supported by the second chuck. The first piston and second pistons may each apply a force to the first wedges and second wedges, respectively.

In some aspects, a method for connecting an end of a first tendon to an end of a second tendon may include pumping fluid into the passageway through an aperture oriented perpendicular to the passageway, a first pressure actuating the first piston and a second pressure actuating the second piston.

In some aspects, a method for connecting an end of a first tendon to an end of a second tendon may include removing at least a portion of the fluid from the passageway after actuating the first piston and the second piston.

In some aspects, a method for connecting an end of a first tendon to an end of a second tendon may include moving the first and second wedges from a first position wherein the first wedges and the second wedges are unsecured with respect to one another to a second position wherein the wedges are secured with respect to one another.

In some aspects, a method for connecting an end of a first tendon to an end of a second tendon may include applying an equal force to the first piston and the second piston.

Independent features and independent advantages will become apparent to those skilled in the art upon review of the detailed description, drawings and claims.

DETAILED DESCRIPTION

The disclosure is not limited in its application to the details of construction and the arrangement of components set forth in the following description or illustrated in the following drawings. The concepts disclosed herein are capable of other embodiments and of being practiced or of being carried out in various ways. Also, it is to be understood that the phraseology and terminology used herein is for the purpose of description and should not be regarded as limiting.

Unless specified or limited otherwise, the terms "mounted," "connected," "supported," and "coupled" and variations thereof encompass both direct and indirect mountings, connections, supports, and couplings. Further, "connected" and "coupled" are not restricted to physical or mechanical connections or couplings.

Figure 1:
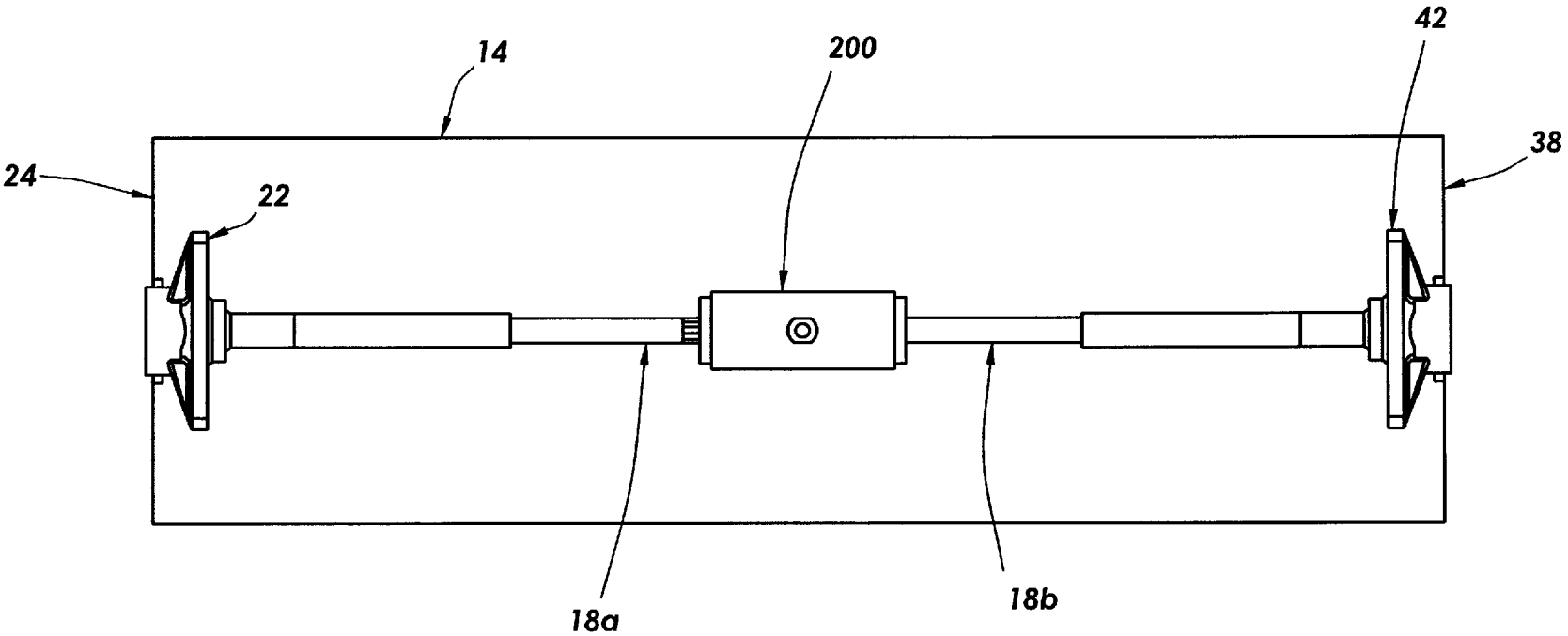
FIG. 1 is a section view of a reinforced concrete structure including a tendon.

FIG. 1 illustrates reinforced concrete structure 14 in which first and second tendons 18*a*, 18*b* extend through concrete structure 14 and are coupled by coupler 200. First anchor 22 may be positioned at first end 24 of concrete structure 14. One end of first tendon 18*a* may be secured to first anchor 22 while the opposite end of first tendon 18*a* may be secured to one end of coupler 200. A first end of second tendon 18*b* may be secured to an opposite end of coupler 200 and a second end of second tendon 18*b* may extend through the concrete to another end 38 of the concrete structure, which may include a partition or an end wall (i.e., an end of the concrete structure). The second end of second tendon 18*b* may be secured to a second anchor 42 positioned adjacent the end 38. Although one tendon and coupler assembly is shown in FIG. 1, the concrete structure may include multiple tendons and/or couplers, which may be oriented parallel to and/or may overlap one another.

Figure 2:
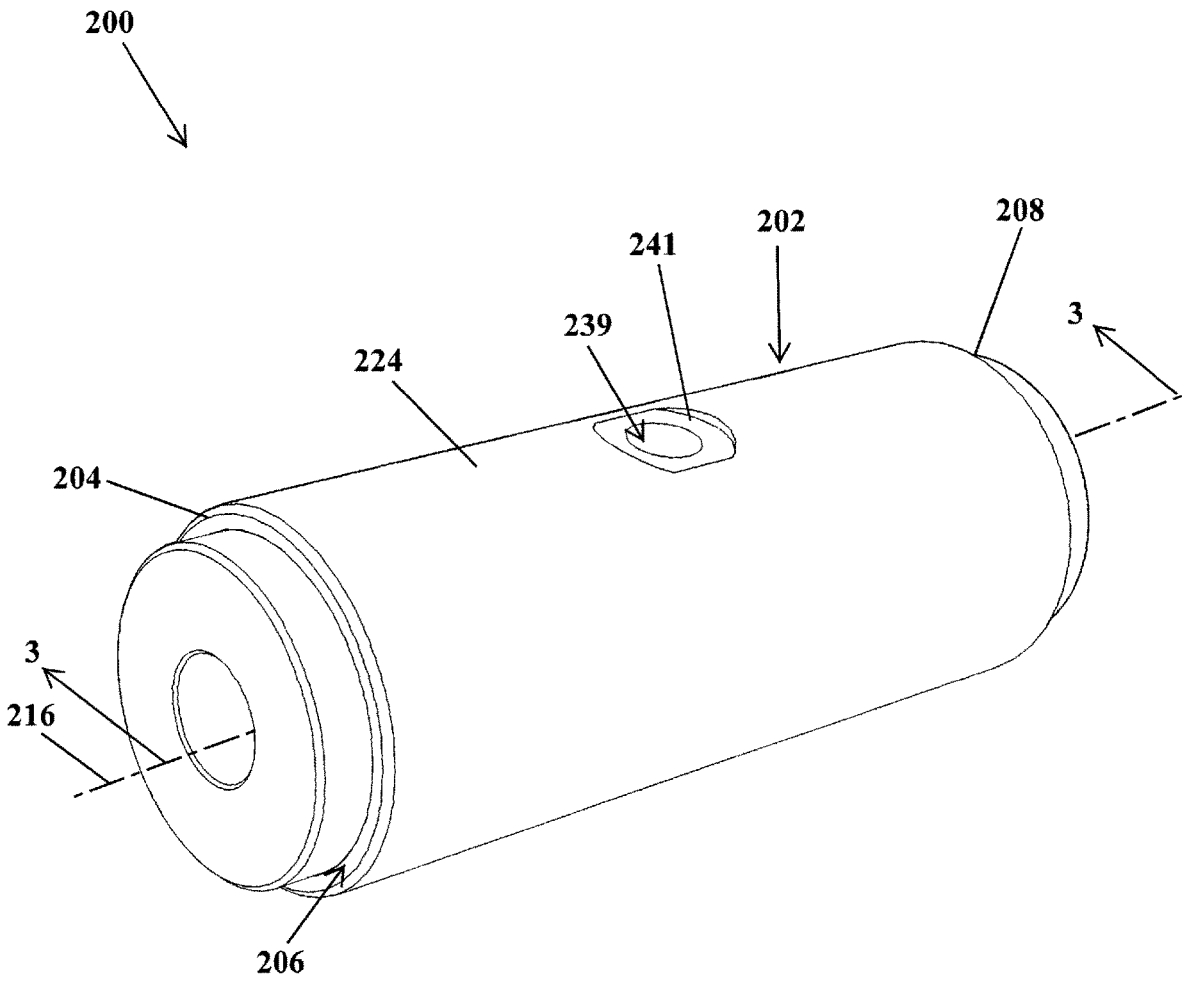
FIG. 2 is a perspective view of a coupler.
Figure 3:
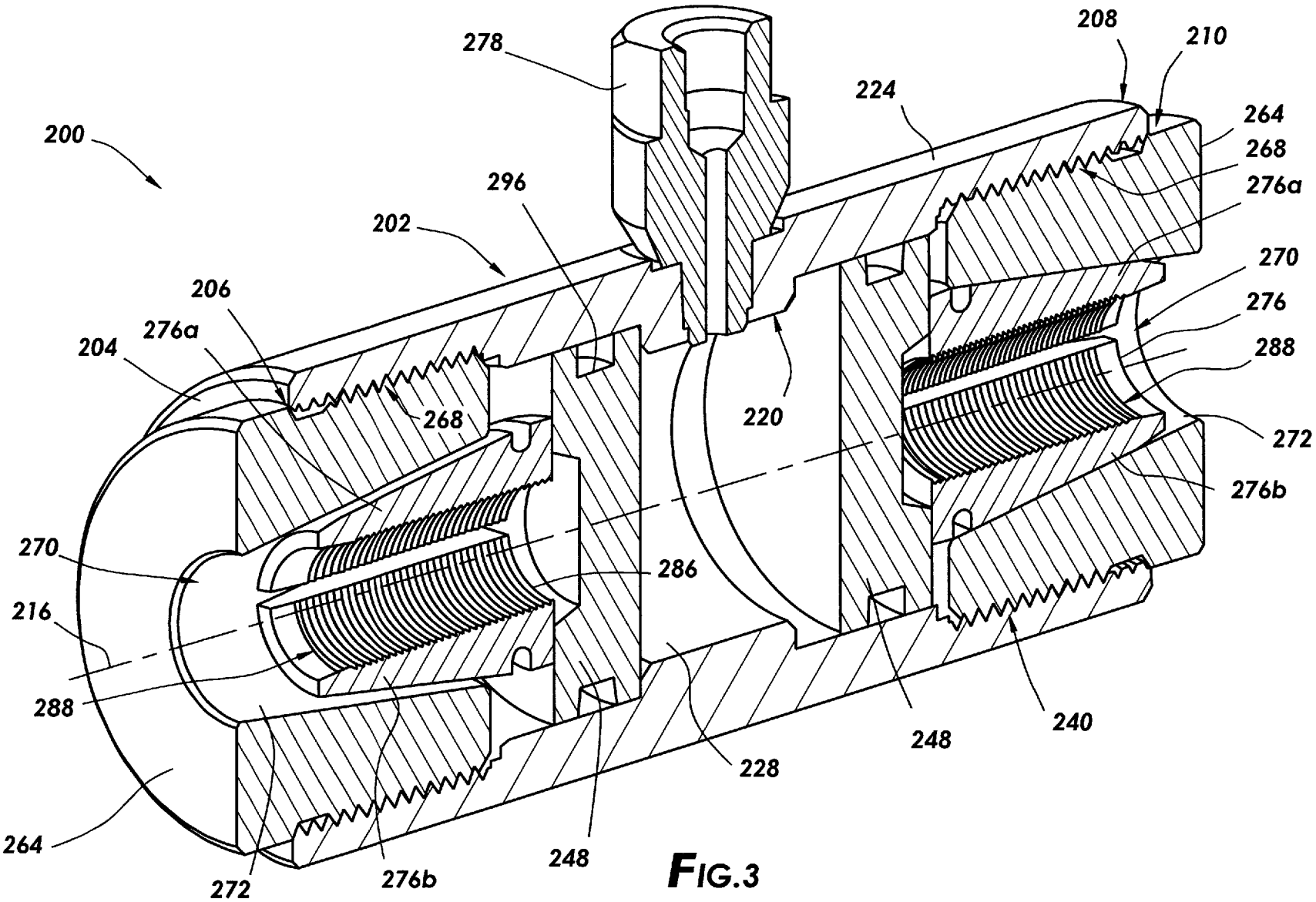
FIG. 3 is a section view of the coupler of FIG. 2, viewed along section 3-3.
Figure 4:
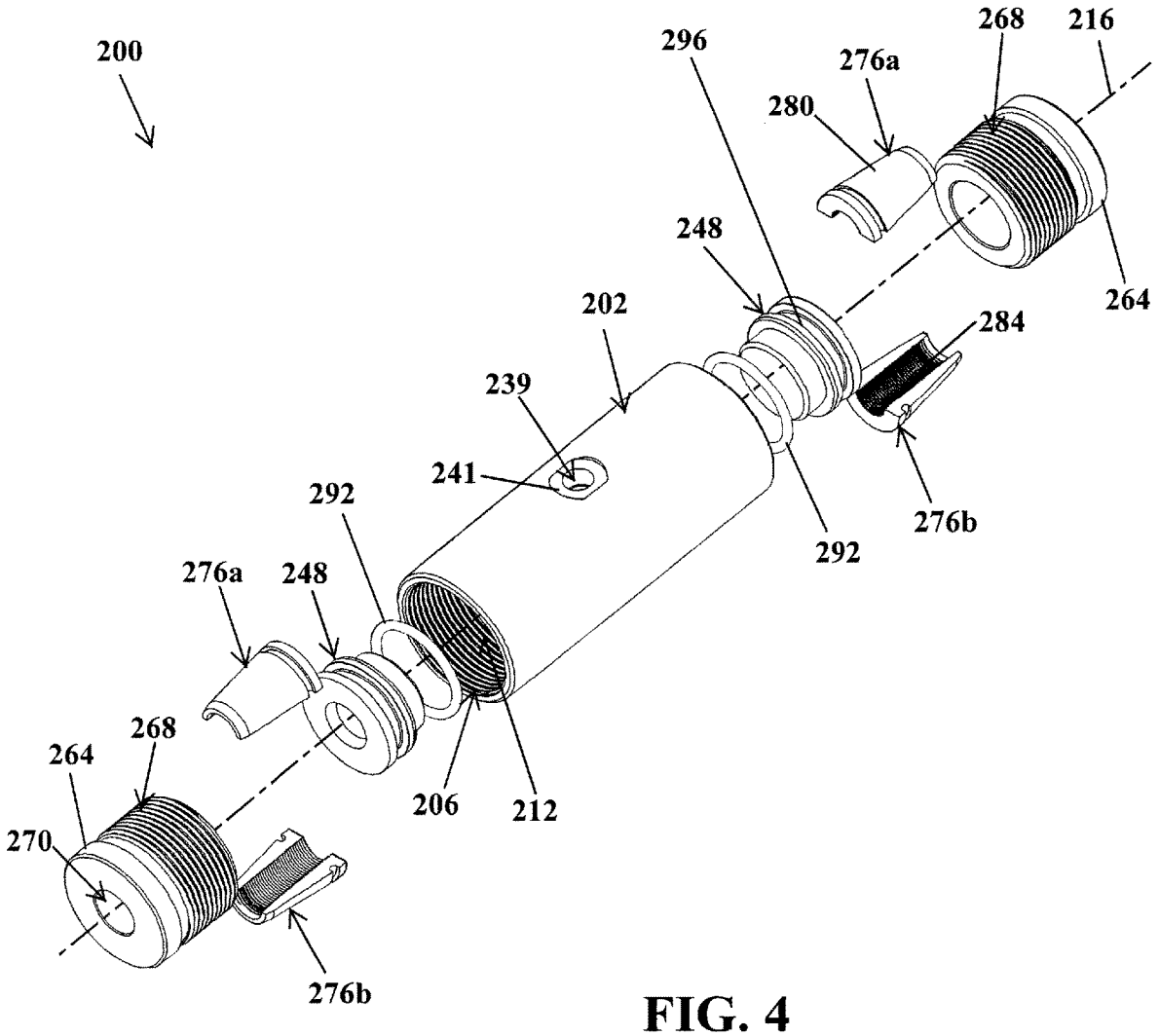
FIG. 4 is an exploded view of the coupler of FIG. 2.

FIGS. 2-4 illustrate coupler 200 including coupler body 202. In the illustrated embodiment, coupler body 202 may be cylindrical and may have first end 204 with first opening 206 and second end 208 with second opening 210. In the illustrated embodiment, body axis 216 extends between first end 204 and second end 208 and passageway 212 (FIG. 4) extends parallel to body axis 216 through coupler body 202 between first opening 206 and second opening 210.

Figure 5:
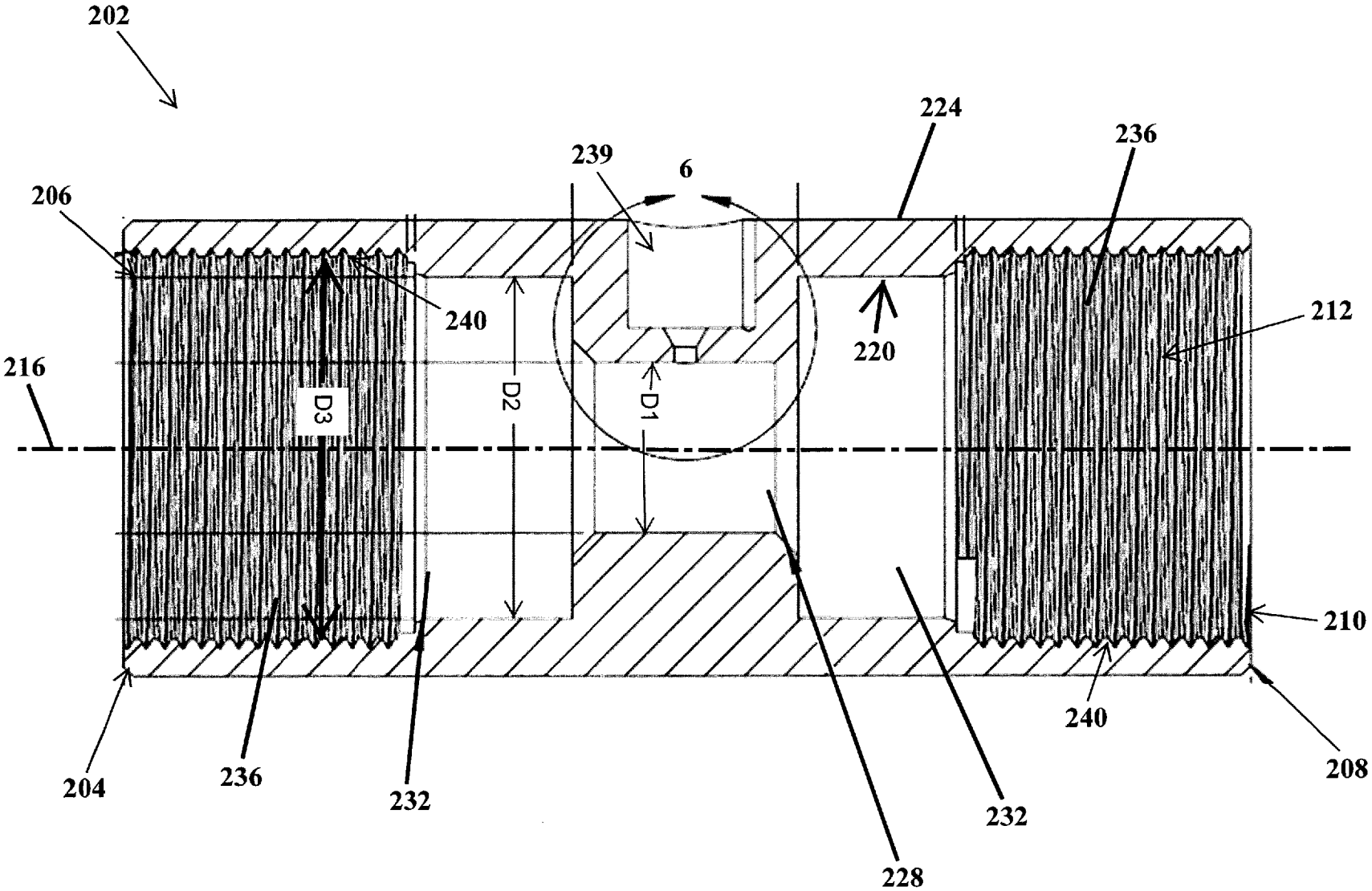
FIG. 5 is an enlarged view of a portion of FIG. 3

As shown in FIG. 5, coupler body 202 may include inner surface 220 and outer surface 224. In the illustrated embodiment, inner surface 220 may be stepped and may include separate sections having different diameters. A first section of inner surface 220 having a diameter $D_1$ defines pressure chamber 228. In some embodiments, pressure chamber 228 may be located at a central point in coupler body 202. On each side of and adjacent to pressure chamber 228, inner surface 220 may define piston chamber 232 having diameter $D_2$, where $D_2$ is larger than $D_1$. The portion of passageway 212 between each piston chamber 232 and respective ends 204, 208 of coupler body 202 defines chuck receiving section 236. Chuck receiving sections 236 may have third diameter $D_3$ that may be larger than $D_2$. Chuck receiving sections 236 may also include threads 240. In the illustrated embodiment, threads 240 extend along a length of each chuck receiving section 236.

Figure 6:
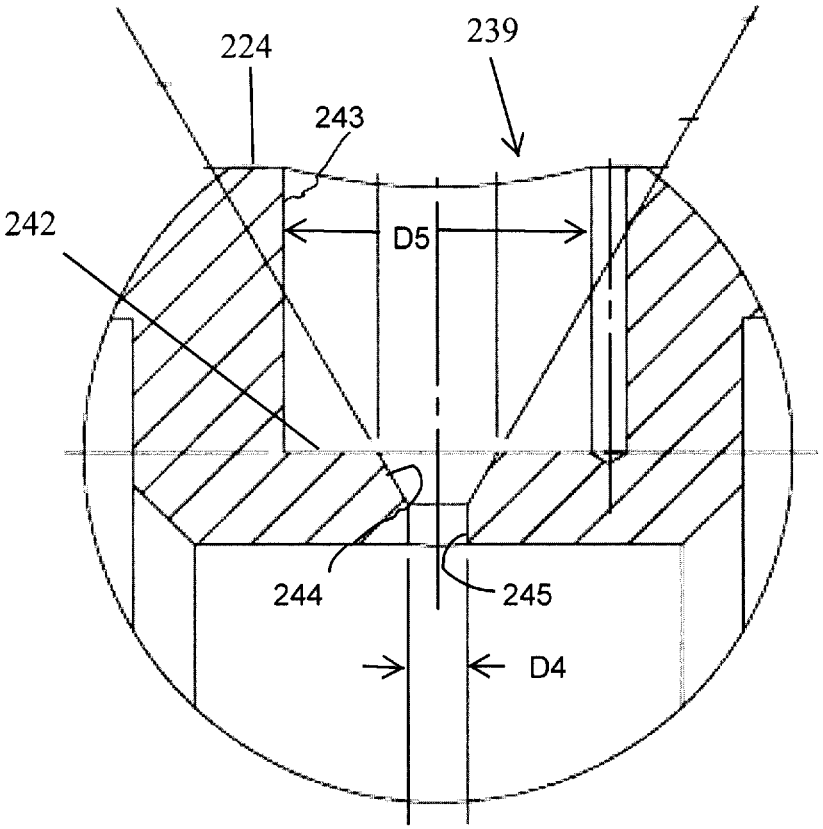
FIG. 6 is an enlarged view of the coupler body of FIG. 5, illustrating area 6.
Figure 11:
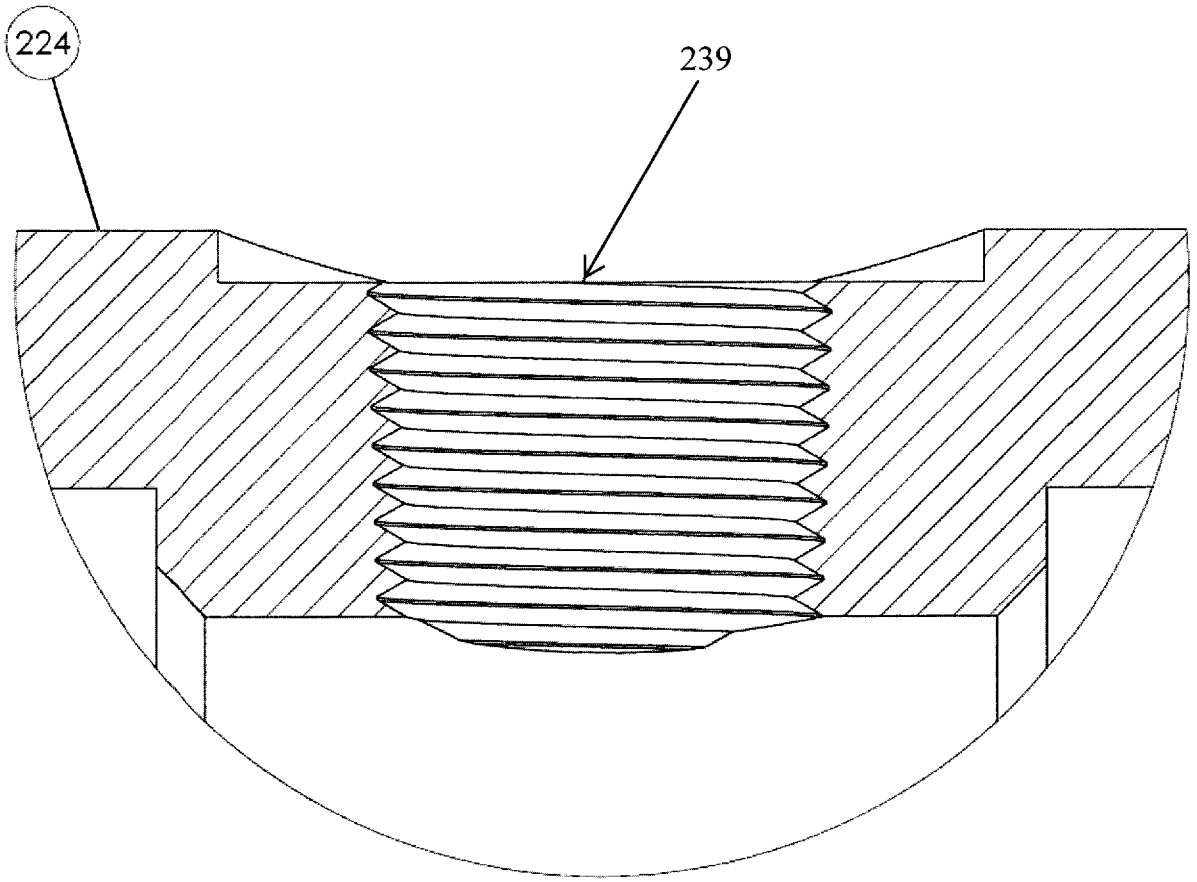
FIG. 11 is an enlarged view of embodiment portion of the coupler of FIG. 10.

In the illustrated embodiment, coupler body 202 also may include access port 239 that extends through the wall of coupler body 202 and provides communication between outer surface 224 and pressure chamber 228. Access port 239 may be perpendicular to body axis 216. As shown in FIG. 6, access port 239 may include a counterbore, including a first portion 243 proximate outer surface 224 and has diameter $D_5$, and second portion 245 that has diameter $D_4$ and extends between first portion 243 and pressure chamber 228. Access port 239 may include shoulder 242 and tapered section 244 between first portion 243 and second portion 245. In the illustrated embodiment, $D_4$ may be less than $D_5$. In some embodiments (e.g., FIG. 11), access port 239 may have a single diameter and may not include a tapered section.

As shown in FIGS. 3 and 4, piston 248 may be slidably positioned within each of piston chambers 232 of coupler body 202 and chuck 264 may be positioned outwardly of each piston 248. Each piston 248 may have a generally cylindrical profile with a diameter approximately equivalent to $D_2$. Piston 248 may be sized and configured to slide into opening 206 and through chuck receiving section 236 and piston chamber 232.

As drawn in FIG. 3, the left-hand piston 248 is shown in an un-seated position and the right-hand piston 248 is shown in a seated position. It will be understood that this depiction is for purposes of illustration only. In most embodiments, both pistons 248 will move substantially in tandem and thus will, for example, both occupy an unseated position before seating and both occupy a seated position after seating.

Chuck 264 may be coupled to coupler body 202 proximate each of first end and second ends 204, 208. Each chuck 264 may have threaded outer surface 268 adapted to mate with threads 240. In the illustrated embodiment, each chuck 264 has an end portion wider than threaded outer surface 268. The end portion may act as a stop surface to prevent chuck 264 from being inserted beyond a predetermined point and can prevent chuck 264 from being flush with end of the body 202. Each chuck 264 may include a tapered bore 270 having internal surface 272. A center of passageway 212 may be aligned with body axis 216. In the illustrated embodiment, internal surface 272 may be tapered and may have its largest diameter proximate piston chamber 232. Chucks 264 may be positioned so that the portions of tapered bores 270 having a largest diameter face one another.

In some embodiments, frustoconical wedge 276 may be positioned within each tapered bore 270. In some embodiments, wedges 276 may include at least first wedge section 276*a* and second wedge section 276*b*. Each wedge section 276*a*, 276*b* may include an frustoconical outer surface 280 and a bore surface 284 (FIG. 4). Outer surfaces 280 may be configured to seat in tapered bore 270. In the illustrated embodiment, bore surfaces 284 include grooves 286. When wedge sections 276*a*, 276*b* fit together, bore surfaces 284 are adjacent and define a tendon-receiving passageway 288. Each recessed surface 284 may have a generally semi-circular profile, so that passageway 288 is generally circular. Passageway 288 may be concentric with body axis 216.

Figure 8:
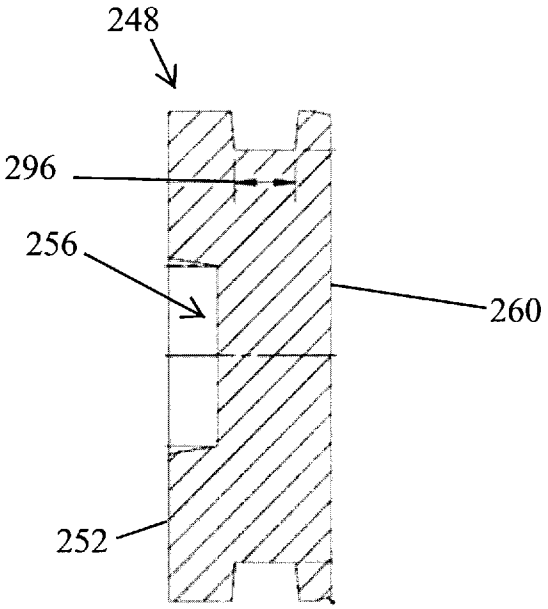
FIG. 8 is a section view of the piston of FIG. 7, viewed along section 8-8.
Figure 7:
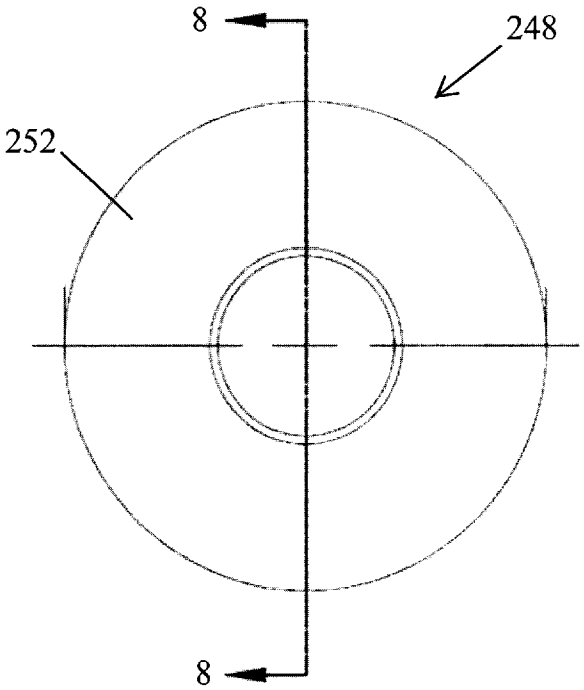
FIG. 7 is an end view of a piston.

As shown in FIGS. 7 and 8, each piston 248 may have front surface 252 and rear surface 260. In the illustrated embodiment, front surface 252 may include recess 256 that may be concentric with an outer perimeter of piston 248. Recess 256 may be generally circular and may include a taper that extends toward rear surface 260. Opening of recess 256 at front surface 252 may have a larger diameter than the back surface of recess 256. Rear surface 260 of piston 248 may be substantially flat. Groove 296 (FIG. 8) may extend around an outer perimeter of piston 248 and may receive seal 292 (FIG. 4) for sealingly engaging inner surface 220. While inserted into coupler body 202, rear surface 260 of each piston 248 may be positioned proximate a stepped surface between piston chamber 232 and pressure chamber 228.

Figure 10:
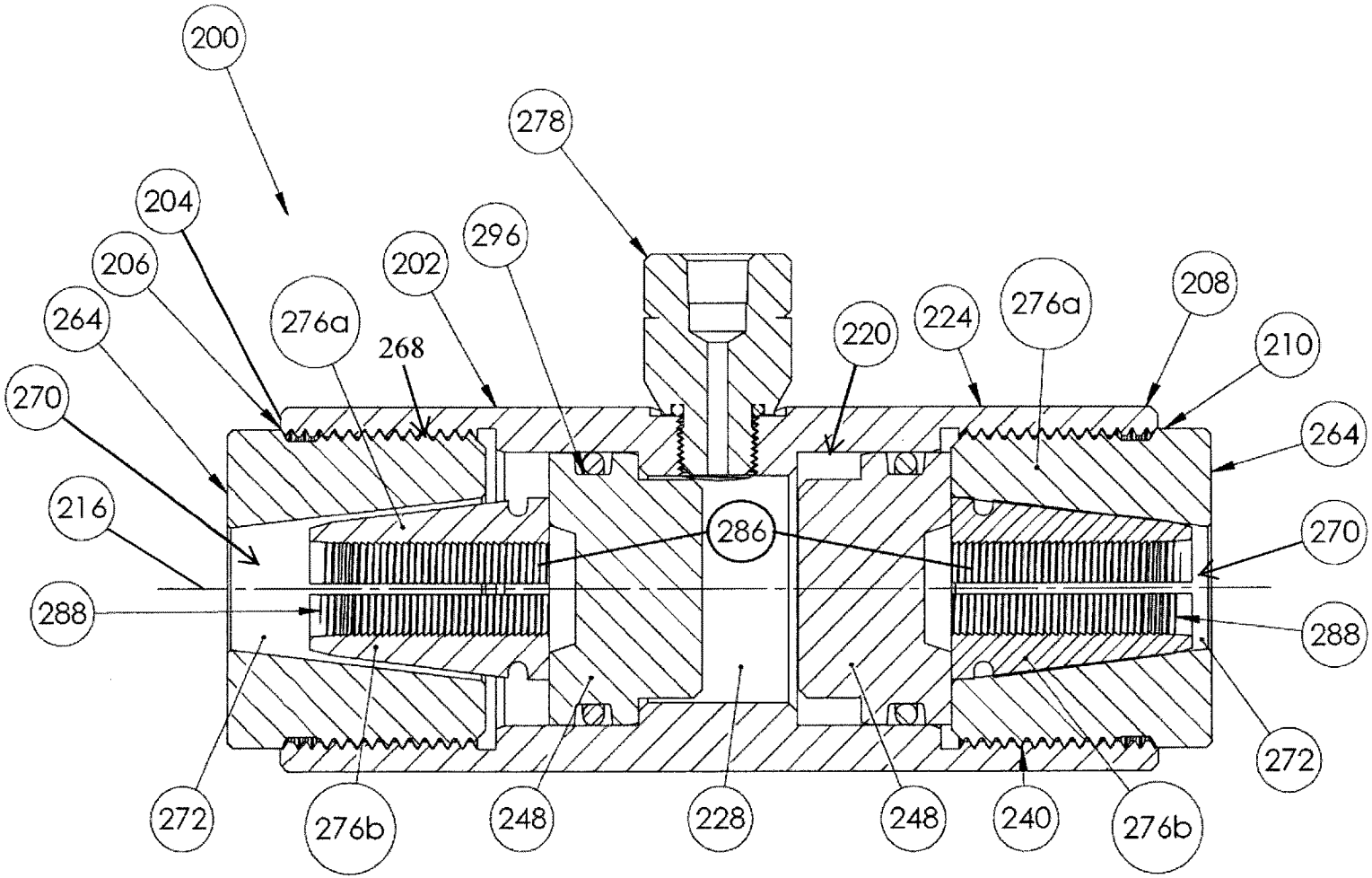
FIG. 10 is a section view of a coupler according to another embodiment.
Figure 12:
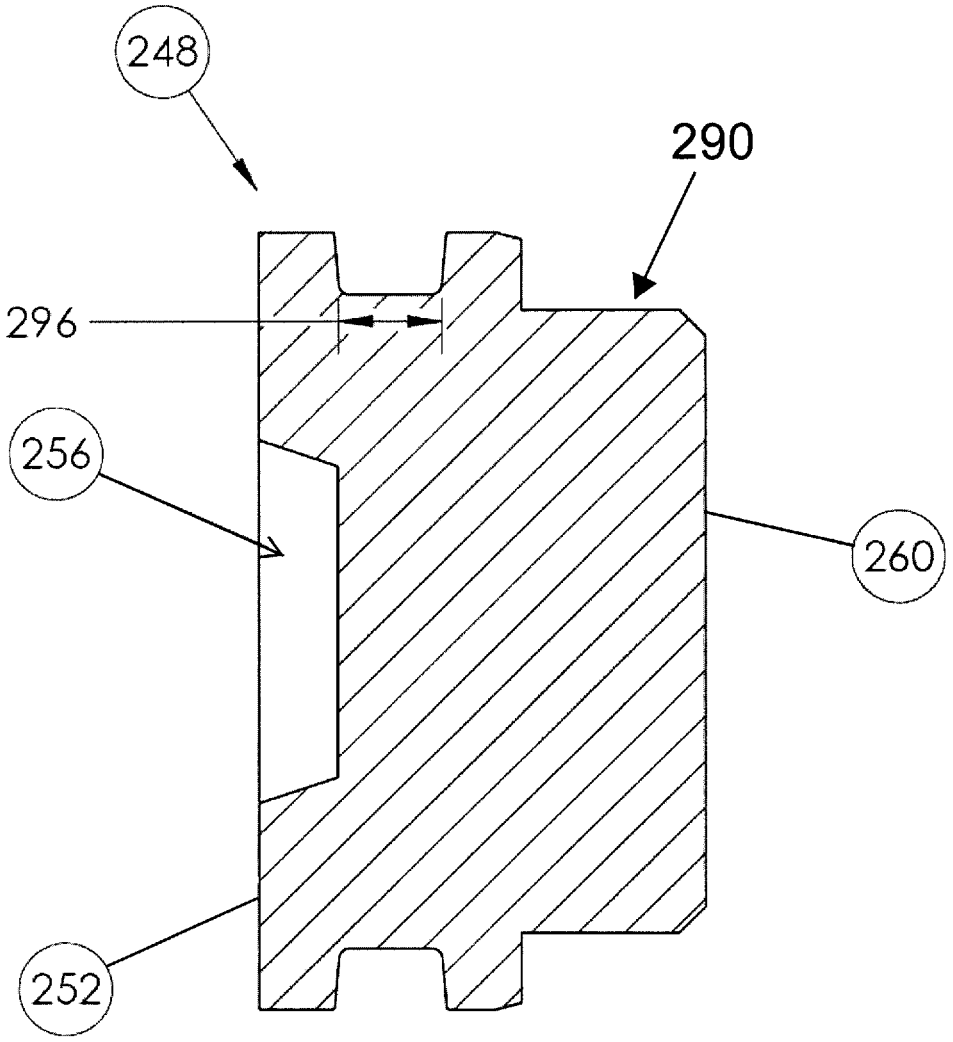
FIG. 12 is a section view of a piston according to another embodiment.

In some embodiments, as shown in FIG. 12, the body of each piston 248 may extend to form shoulder portion 290 and rear surface 260 may be spaced farther from front surface 252 than piston 248 shown in FIG. 8. Shoulder portion 290 may also extend into pressure chamber 228 while piston 248 is positioned within coupler body 202 (FIG. 10), thereby reducing the volume of air present in pressure chamber 228.

In operation, an end of first tendon 18*a* (FIG. 1) may be coupled to chuck 264 proximate first end 204 of coupler body 202 and an end of second tendon 18*b* (FIG. 1) may be coupled to another chuck 264 proximate second end 208 of coupler body 202. Each of the tendons 18*a*, 18*b* may be received within passageway 288 of wedge sections 276*a*, 276*b* as the tendon moves into the respective chucks 264. Tendons 18*a*, 18*b* and wedges 276 move toward each other as tendons 18*a*, 18*b* are inserted toward respective pistons 248 and tendons 18*a*, 18*b* may force the respective wedge sections 276*a*, 276*b* apart so that passageway 288 becomes wider. If desired, the end of each tendon 18*a*, 18*b* may be positioned within or adjacent to the recess 256 of respective pistons 248. If present, a wave spring may resist dislodgement of wedge 276 from each chuck 264.

After tendons 18*a*, 18*b* are positioned within cavity 288, a force may be applied within coupler body 202 urge wedge sections 276*a*, 276*b* into each chuck 264 and thereby seat wedges 276. In the embodiment illustrated in FIG. 3, nozzle 278 connected to a fluid source may be coupled to access port 239 to inject a pressurized fluid (e.g., oil, grease) from a pump (not shown) into passageway 212. If desired, nozzle 278 may include a stepped surface abutting shoulder 242 and nozzle 278 may direct fluid through tapered section 244 (FIG. 6). If desired, such as, for example, if nozzle 278 is a high pressure nozzle, access port 239 may include threads for engaging nozzle 278.

Fluid from nozzle 278 enters pressure chamber 228 and flows toward piston chambers 232. The fluid contacts surfaces 260 of pistons 248 and applies an outward hydraulic force. The fluid applies a force directed toward the ends 204, 208 of coupler body 202. The hydraulic force applied to each piston may be equal. In some embodiments, seal 292 may be positioned in groove 296 of each piston 248 so as to limit fluid flowing around each pistons 248. The hydraulic force urges each piston 248 outwardly, away from the other piston and toward a respective end of coupler body 202. As each piston 248 moves, each piston 248 contacts wedge sections 276*a*, 276*b* in respective chuck 264 and advances wedge sections 276*a*, 276*b* into tapered bore 270 (see rightmost piston 248 in FIG. 3). In some embodiments, a biasing element (e.g., a wave spring or wave washer—not shown) may be positioned within the body to provide a nominal biasing force on wedges 276 to initially seat wedge 276 within tapered bore 270. As a result, as pistons 248 are urged outwardly, each piston 248 first engages an end of the associated tendon and then contacts the associated wedge 276. Pistons 248 can seat wedges 276 with a minimal applied load.

In other embodiments, another mechanism may be used for actuating pistons 248. Instead of introducing pressurized fluid, which may be, for example, a hydraulic fluid or pneumatic fluid, into coupler body 202, a mechanical device may be used to apply a force or torque on pistons 248 to move them against wedges 276. In some embodiments, a chemical may be introduced into the space between pistons 248 and a catalyst may be introduced to cause a chemical reaction that increases the pressure in the space between pistons 248 and drives each piston 248 against its respective wedge 276. The chemical reaction may include, among other things, igniting or combusting a fuel.

Figure 9:
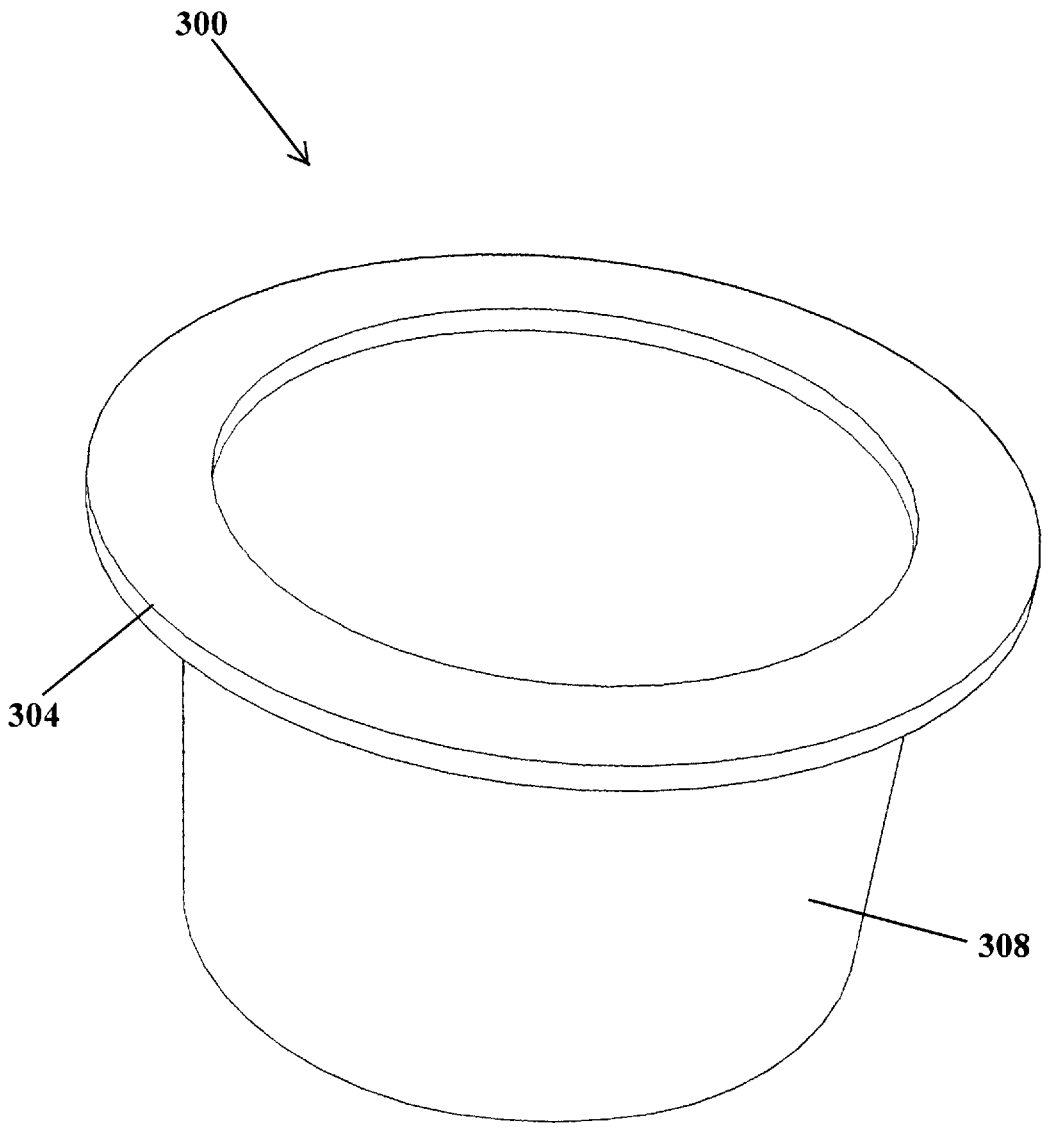
FIG. 9 is a perspective view of a plug.

As wedge sections 276*a*, 276*b* move into tapered bore 270, the taper of internal surface 272 forces wedge sections 276*a*, 276*b* together. The diameter of passageway 288 may be reduced. Reducing the diameter of passageway 288 secures tendons 18*a*, 18*b* to coupler 200. Additionally, grooves 286 on bore surfaces 284 may grip tendons 18*a*, 18*b* as wedge sections 276*a*, 276*b* are seated. Once wedge sections 276*a*, 276*b* are fully seated within tapered bore 270 (i.e., piston 248 can no longer move wedge sections 276*a*, 276*b* farther into chuck 264), tendons 18*a*, 18*b* are secured within coupler. Nozzle 278 may be removed from aperture 239. In some embodiments, at least some of the fluid in passageway 212 may be retained to provide corrosion protection. In other embodiments, the fluid may be drained from passageway 212 via aperture 239. Plug 300 (FIG. 9) may be used to seal the access port 239 after nozzle 278 has been removed to further seal passageway 212. In some embodiments, plug 300 may include a cap body 308 and a flange portion 304. Cap body 308 may be inserted into access port 239 until flange portion 304 contacts a flat portion 241 of outer surface 224. In some embodiments (e.g., FIGS. 10 and 11), access port 239 may be threaded so as to engage a threaded nozzle 278. Cap body 308 may also be threaded.

Providing an internal force may require less total force to seat the wedge sections 276*a*, 276*b* than may be required using an external force (e.g., tensioning tendons 18*a*, 18*b* with a jack). Additionally, applying an internal force limits any need to remove a portion of the tendon sheath (not shown) from tendons 18*a*, 18*b*. Furthermore, if coupler 200 is used to repair/splice two tendons 18*a*, 18*b* after the surrounding concrete has set, only a section of concrete slightly larger than coupler 200 needs to be cut in order to seat wedge sections 276*a*, 276*b*.

In some embodiments, after pistons 248 have fully seated wedges 276, tendons 18*a*, 18*b* must be re-tensioned. By way of example, tendon 18*a* may be tensioned, (e.g., by a hydraulic tensioner—not shown, applied at first anchor 22). As the tension may be applied, wedge sections 276*a*, 276*b* may move farther into tapered bore 270 as wedge sections 276*a*, 276*b* move with tendon 18*a*. An excess portion of the tendon tail (i.e., the portion extending beyond a minimum protruding from the first chuck 264) may be removed. Similar steps may be applied to tension the second tendon 18*b*.

Although aspects have been described in detail with reference to certain preferred embodiments, variations and modifications exist within the scope and spirit of one or more independent aspects as described. Likewise, unless an order of steps is explicitly stated, the sequential recitation of steps in the claims that follow is for clarity only and is not a requirement that the steps performed in the sequence recited.

What is claimed is:

1. A coupler for connecting an end of a first tendon to an end of a second tendon, the coupler comprising:

a body including a first end and a second end, the body having a passageway therethrough and an access port;

a first wedge configured to receive the end of the first tendon and a second wedge configured to receive the end of the second tendon, the first and second wedges being positioned in the passageway;

a first piston slidably positioned within the passageway proximate the first wedge; and a second piston slidably positioned within the passageway proximate the second wedge;

wherein the first and second pistons each have a rear surface, and wherein the rear surfaces define a pressure chamber in the passageway; and wherein the pressure chamber is in fluid communication with the access port and wherein when pressure is applied to the pressure chamber by pumping a fluid into the passageway through the access port, the first and second pistons are adapted to urge the first and second wedges apart.

2. The coupler of claim 1 wherein the first piston and the second piston each include a recess configured to receive an end of a tendon.

3. The coupler of claim 1, further comprising a first chuck receiving the first wedge and a second chuck receiving the second wedge, the first chuck having an outer surface including first external threads and the second chuck having an outer surface including second external threads, wherein the first end of the coupler body includes first internal threads configured to engage the first external threads and the second end of the coupler body includes second internal threads configured to engage the second external threads.

4. The coupler of claim 3 wherein the first and second chuck each include a tapered bore, wherein the first wedge is positioned in the tapered bore of the first chuck and the second wedge is positioned in the tapered bore of the second chuck.

5. The coupler of claim 1 wherein each piston has an outer surface, and wherein a seal is positioned on the outer surface of each piston so as to limit fluid flowing around each piston.

6. The coupler of claim 1 wherein the access port includes threads.

7. A method for connecting an end of a first tendon to an end of a second tendon, the method comprising:

a) positioning a coupler between the end of the first tendon and the end of the second tendon, the coupler including:

a coupler body including a first end and a second end, the coupler body having a passageway therethrough and an access port;

a first wedge and a second wedge, each of the first and second wedges being positioned in the passageway;

a first piston positioned within the passageway proximate the first wedge; and a second piston positioned within the passageway proximate the second wedge;

wherein the first and second pistons each have a rear surface, and wherein the rear surfaces define a pressure chamber in the passageway; and wherein the pressure chamber is in fluid communication with the access port;

b) inserting the end of the first tendon into the first wedge;

c) inserting the end of the second tendon into the second wedge;

d) applying a pressure to the pressure chamber by pumping a fluid into the passageway through the access port, so as to cause the first and second pistons to urge the first and second wedges apart.

8. The method of claim 7 further comprising engaging a nozzle in the access ports using threads.

9. The method of claim 7, wherein each piston has an outer surface, and wherein a seal is positioned on the outer surface of each piston further comprising:

limiting fluid flowing around each piston through use of the seal.

10. The method of claim 7 wherein step d) comprises activating a chemical reaction in the pressure chamber.

11. The method of claim 7, further comprising removing at least a portion of the fluid from the passageway after actuating the first piston and the second piston.

12. The method of claim 7 wherein step d) includes moving the first and second wedges from an un-seated position to a seated position.

13. The method of claim 7 wherein step d) comprises applying an equal force to the first piston and the second piston.

14. The method of claim 7 further comprising receiving an end of a reinforcing tendon in a recess of the first piston and the second piston.

15. The method of claim 7 further comprising:

supporting a first edge using a first chuck supporting the first wedge;

retaining the first wedge in the coupler body;

supporting the second wedge using a second chuck; and retaining the second wedge in the coupler body.

16. The method of claim 15 wherein the first and second chuck each include a tapered bore, wherein the first wedge is positioned in the tapered bore of the first chuck and the second wedge is positioned in the tapered bore of the second chuck.

* * * * *